US007419105B2

(12) United States Patent
Wang et al.

(10) Patent No.: US 7,419,105 B2
(45) Date of Patent: Sep. 2, 2008

(54) SPRAY OSCILLATING CONTROL APPARATUS FOR SPRINKLERS

(75) Inventors: King Yuan Wang, Changhua Hsien (TW); Shun Nan Lo, Changhua Hsien (TW)

(73) Assignee: Yuan Mei Corp., Changhua Hsien (TW)

( * ) Notice: Subject to any disclaimer, the term of this patent is extended or adjusted under 35 U.S.C. 154(b) by 184 days.

(21) Appl. No.: 11/349,157

(22) Filed: Feb. 8, 2006

(65) Prior Publication Data

US 2007/0119979 A1 May 31, 2007

(30) Foreign Application Priority Data

Nov. 30, 2005 (TW) ..... 94142080

(51) Int. Cl.
*B05B 3/16* (2006.01)

(52) U.S. Cl. ..... 239/242; 239/230; 239/240; 239/263.3; 239/237

(58) Field of Classification Search ..... 239/230, 239/240, 242, 237, 263.3
See application file for complete search history.

(56) References Cited

U.S. PATENT DOCUMENTS

| | | | | |
|---|---|---|---|---|
| 3,034,728 | A * | 5/1962 | Hruby, Jr. | 239/206 |
| 3,977,610 | A | 8/1976 | Royer | 239/230 |
| 4,069,976 | A * | 1/1978 | Chauvigne | 239/242 |
| 4,140,278 | A | 2/1979 | Troup | 239/242 |
| 4,166,578 | A | 9/1979 | Skwara | 239/242 |
| 4,220,284 | A | 9/1980 | Beiswenger et al. | 239/242 |
| 4,221,333 | A | 9/1980 | Rodriguez | 239/255 |
| 4,545,532 | A | 10/1985 | Schanz et al. | 239/242 |
| 4,568,023 | A | 2/1986 | Hayes | 239/242 |
| 4,568,024 | A | 2/1986 | Hunter | 239/242 |
| 4,606,500 | A | 8/1986 | Mussler et al. | 239/242 |
| 4,708,291 | A | 11/1987 | Grundy | 239/242 |
| 4,718,605 | A | 1/1988 | Hunter | 239/242 |
| 4,721,248 | A | 1/1988 | Chow | 239/242 |
| 4,860,954 | A | 8/1989 | Allemann | 239/101 |
| 4,877,185 | A | 10/1989 | Kufrin | 239/242 |
| 4,895,305 | A | 1/1990 | Powell | 239/239 |

(Continued)

FOREIGN PATENT DOCUMENTS

| | | |
|---|---|---|
| CA | 2266247 | 9/2000 |

(Continued)

*Primary Examiner*—Len Tran
*Assistant Examiner*—Trevor E. McGraw
(74) *Attorney, Agent, or Firm*—Troxell Law Office, PLLC

(57) ABSTRACT

A spray oscillating control apparatus for sprinklers is equipped with a sprinkling control assembly to swing a spray body into different angles wherein a gear train assembly with an impeller is mounted into the sprinkling control assembly and work in linking mechanism with a spray oscillating control apparatus composed of a water duct having two inlet orifices and a spray control device having a linkage gear wheel and two covering blocks. The linkage gear wheel is directly meshed with one matched gear of the gear train assembly and the two covering blocks are matched to the two inlet orifices, permitting the linkage gear wheel and the two covering blocks to rotate along with the gear train assembly and, thus, switch the amount of intake water supply in a gradual manner so that spray sprinkled can oscillate rhythmically from far-to-near and near-to-far in distance, achieving even distribution of the spray onto a lawn.

7 Claims, 13 Drawing Sheets

U.S. PATENT DOCUMENTS

| | | | | | |
|---|---|---|---|---|---|
| 4,948,052 | A | | 8/1990 | Hunter | 239/242 |
| 4,955,542 | A | | 9/1990 | Kah, Jr. | 239/242 |
| 4,971,256 | A | * | 11/1990 | Malcolm | 239/230 |
| 4,972,993 | A | | 11/1990 | Van Leeuwen | 239/206 |
| 5,033,678 | A | | 7/1991 | Borghese et al. | 239/242 |
| 5,042,719 | A | | 8/1991 | Magris et al. | 239/242 |
| 5,098,020 | A | * | 3/1992 | Cooper et al. | 239/230 |
| 5,148,991 | A | * | 9/1992 | Kah, Jr. | 239/242 |
| 5,305,956 | A | | 4/1994 | Wang | 239/242 |
| 5,511,727 | A | * | 4/1996 | Heren et al. | 239/242 |
| 5,562,247 | A | * | 10/1996 | Roman | 239/240 |
| 5,628,458 | A | | 5/1997 | Kuo | 239/242 |
| 5,645,218 | A | * | 7/1997 | Heren et al. | 239/242 |
| 5,653,390 | A | | 8/1997 | Kah, Jr. | 239/242 |
| 5,673,714 | A | * | 10/1997 | Campagnolo et al. | 134/57 D |
| 5,673,717 | A | * | 10/1997 | Jinback | 134/167 R |
| 5,676,315 | A | * | 10/1997 | Han | 239/590 |
| 5,704,549 | A | | 1/1998 | Kephart et al. | 239/236 |
| 5,730,366 | A | | 3/1998 | DeWitt | 239/242 |
| 5,735,462 | A | * | 4/1998 | Roman | 239/242 |
| 5,758,827 | A | * | 6/1998 | Van Le et al. | 239/242 |
| 5,845,850 | A | | 12/1998 | Guo | 239/242 |
| 5,868,318 | A | | 2/1999 | Roman | 239/242 |
| 5,938,122 | A | * | 8/1999 | Heren et al. | 239/242 |
| 6,109,545 | A | | 8/2000 | Kah, Jr. | 239/242 |
| 6,334,577 | B1 | | 1/2002 | Chih | 239/242 |
| 6,336,597 | B1 | | 1/2002 | Kah, Jr. | 239/242 |
| 6,732,952 | B2 | | 5/2004 | Kah, Jr. | 239/225.1 |
| 6,817,543 | B2 | | 11/2004 | Clark | 239/205 |
| 6,869,026 | B2 | * | 3/2005 | McKenzie et al. | 239/237 |
| 6,945,471 | B2 | * | 9/2005 | McKenzie et al. | 239/237 |
| 7,086,609 | B2 | * | 8/2006 | Wang | 239/263.3 |
| 2007/0119979 | A1 | * | 5/2007 | Wang et al. | 239/242 |

FOREIGN PATENT DOCUMENTS

| | | | |
|---|---|---|---|
| DE | 1965958 | B2 | 3/1969 |
| DE | 3942086 | A1 | 12/1989 |
| EP | 0363717 | B1 | 4/1990 |
| EP | 0148905 | B1 | 9/1990 |
| EP | 0392712 | A2 | 10/1990 |
| EP | 0394653 | B1 | 8/1993 |
| EP | 0572746 | A1 | 12/1993 |
| EP | 0826427 | A2 | 3/1998 |
| EP | 0798047 | B1 | 8/2002 |
| FR | 2684568 | A1 | 6/1993 |
| GB | 1149287 | | 4/1969 |
| GB | 1176978 | | 1/1970 |
| GB | 2322572 | A | 9/1998 |
| WO | 85/00304 | | 1/1985 |
| WO | 2005/020663 | A1 | 3/2005 |

* cited by examiner

SPRAY OSCILLATING CONTROL APPARATUS FOR SPRINKLERS

BACKGROUND OF THE INVENTION

The present invention relates to a spray oscillating control apparatus for sprinklers wherein two opposite inlet orifices of a water duct cooperatively work with covering blocks and water intake passageways of a spray control device, and a linkage gear wheel of the spray control device is directly meshed with one matched gear of a gear train assembly to rotate the covering blocks in linkage so as to switch the amount of intake water supply in a sequential order; thereby the spray control device can avoid being interfered by the water stream, and the gear train assembly can accurately rotate the spray control device in a smooth and efforts-saving manner.

Please refer to FIG. 1 showing a perspective cross sectional view of a conventional spray oscillating control apparatus for sprinklers. Such a spray oscillating control apparatus includes a sprinkling device 10 wherein water stream passing through an inlet port 11 is jetted towards a water wheel 12, causing the rotation of the water wheel 12 and the actuation of a gear shaft 13 therewith. Then, the gear shaft 13 will drive a worm gear 14 and cause a cylindrical wheel 15 fixed to the same axle to rotate with the worm gear 14 as well. A protruding shaft 161 abutted against a spiral guiding recess 151 of the cylindrical wheel 15 will be pushed by the rotation of the spiral guiding recess 151 and limited to move back and forth within an oval-shaped elongated slot 171 of a sliding seat 17. Accordingly, an integrally molded plug body 16 is forced to move back and forth towards or away from a water outlet orifice 18 so as to change the room of water discharge and, thus, vary the amount of water sprinkled through the water outlet orifice 18 thereof.

There are some disadvantages to such a conventional spray oscillating control apparatus for sprinklers. First, the water stream rotating the water wheel 12 must be projected under a sufficient water pressure so as to actuate the rotation of the cylindrical wheel 15 and the plug body 16 in a sequence. In case of a low water pressure, the water stream jetted towards the water wheel 12 becomes impotent to rotate the cylindrical wheel 15 and the plug wheel 16 which, subjected to interference from each other, tends to stop rotating in operation thereof. Second, when the plug body 16 moves back and forth within the sliding seat 17 thereof, water stream can infiltrate into the sliding seat 17 via the oval-shaped elongated slot 171. Therefore, even in case of a high water pressure, the water stream accumulated within the sliding seat 17 thereof can form a layer of resistance, causing the plug body 16 to be blocked thereby. Besides, the water wheel 12 can also be interfered by the plug body 16 and becomes hard to rotate in operation thereof.

Another conventional spray oscillating control apparatus for sprinklers is disclosed in the U.S. Pat. No. 4,860,954 wherein the sprinkler utilizes the rotation of an impeller to actuate the back-and-forth movement of a shaft, and an eccentric cam is disposed at one end of the shaft in communication with a tube. Most of all, the second prior art makes use of numerous assembly parts and is characterized by a complicated structure, which makes it rather difficult and time-consuming to assemble.

SUMMARY OF THE PRESENT INVENTION

It is, therefore, the primary object of the present invention to provide a spray oscillating control apparatus for sprinklers wherein a linkage gear wheel of a spray control device is directly meshed with one matched gear of a gear train assembly to provide a linkage mechanism, permitting a set of covering blocks to rotate in a gradual manner to switch the amount of intake water supply so that the spray control device can avoid being interfered by water stream in operation, and the gear train assembly can accurately actuate the rotation of the spray control device in an easy and smooth manner.

It is, therefore, the second object of the present invention to provide a spray oscillating control apparatus for sprinklers wherein a set of inlet orifices of a water duct cooperatively work with the covering blocks and water intake passageways of the spray control device, and the linkage gear wheel of the spray control device is directly rotated by the gear train assembly thereof in a gradual manner, facilitating an easier and more accurate operation and design of the present invention thereby.

DETAILED DESCRIPTION OF THE PREFERRED EMBODIMENTS

Figure 1:
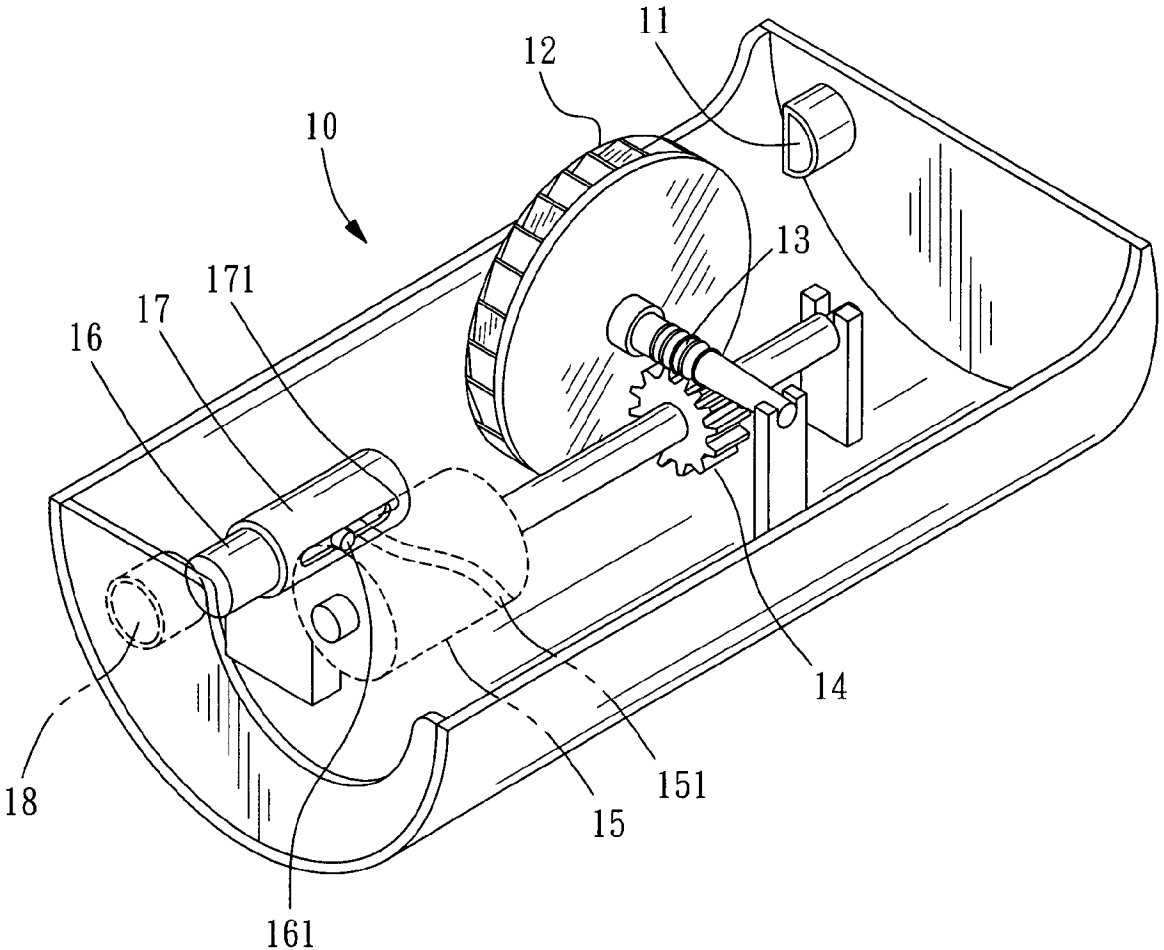
FIG. 1 PRIOR ART
FIG. 1 is a perspective cross sectional view of a conventional spray oscillating control apparatus for sprinklers.
Figure 2:
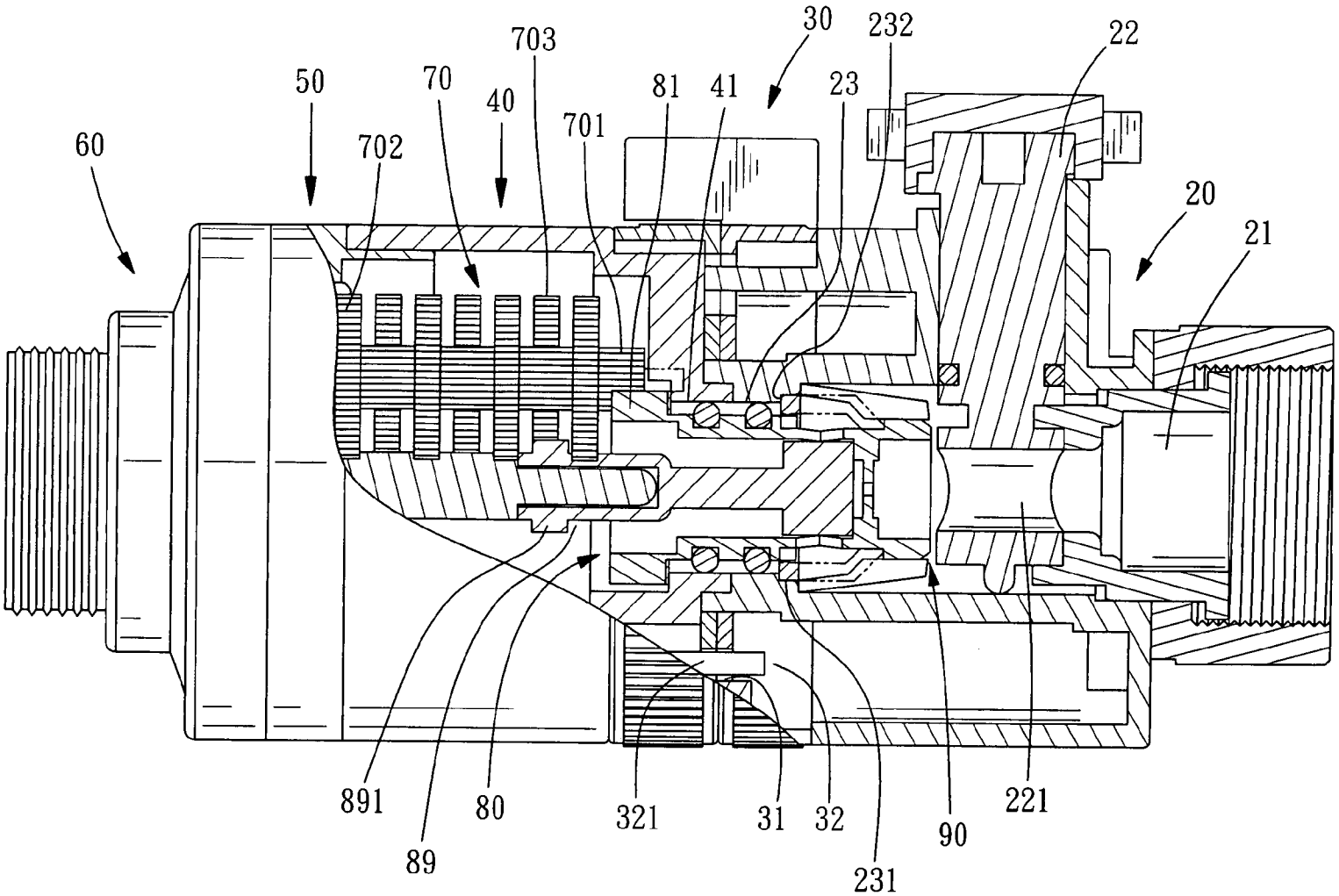
FIG. 2 is a cross sectional of the assembly of the present invention.
Figure 3:
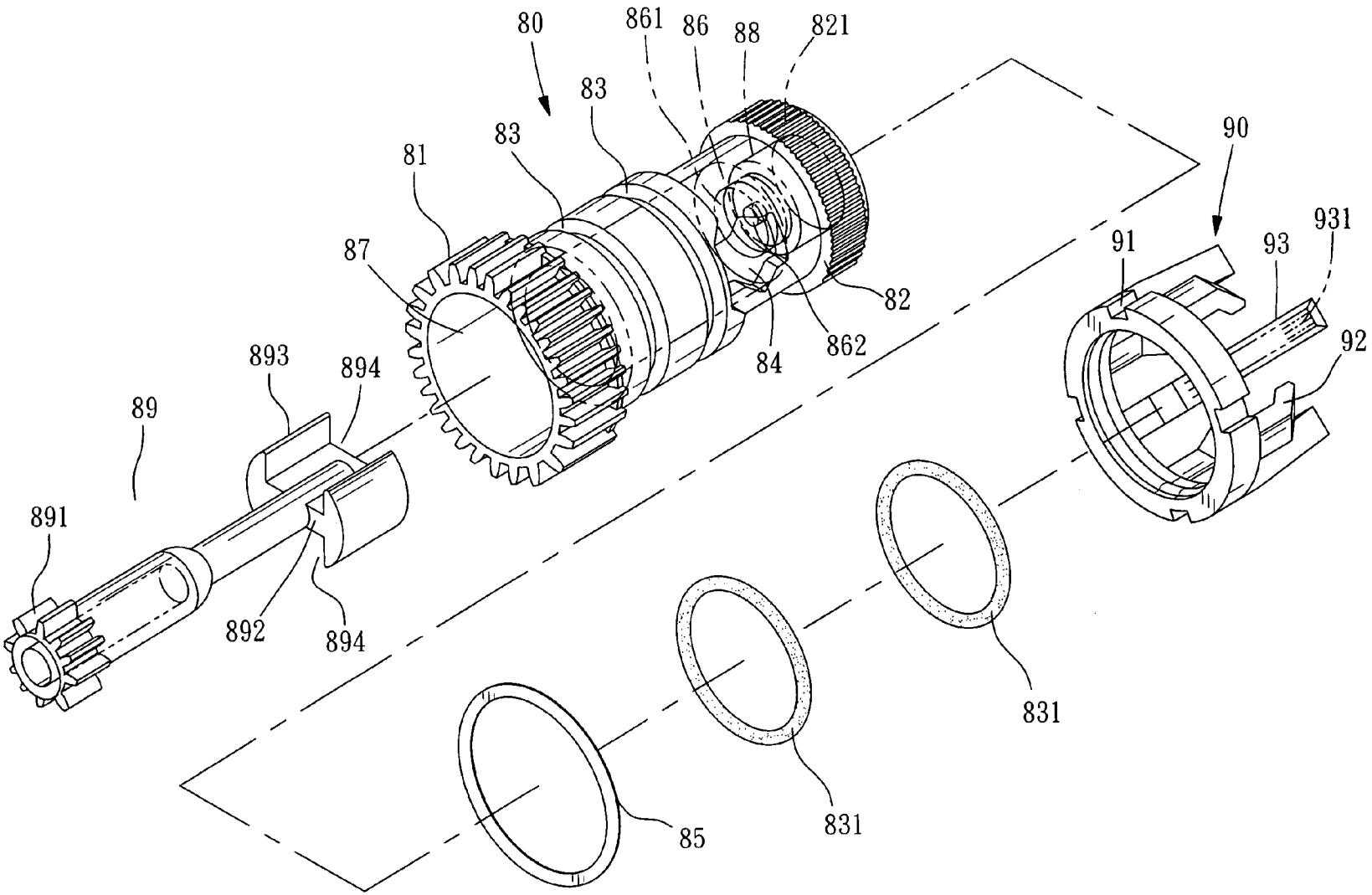
FIG. 3 is an exploded perspective view of a spray oscillating control apparatus of the present invention.
Figure 4:
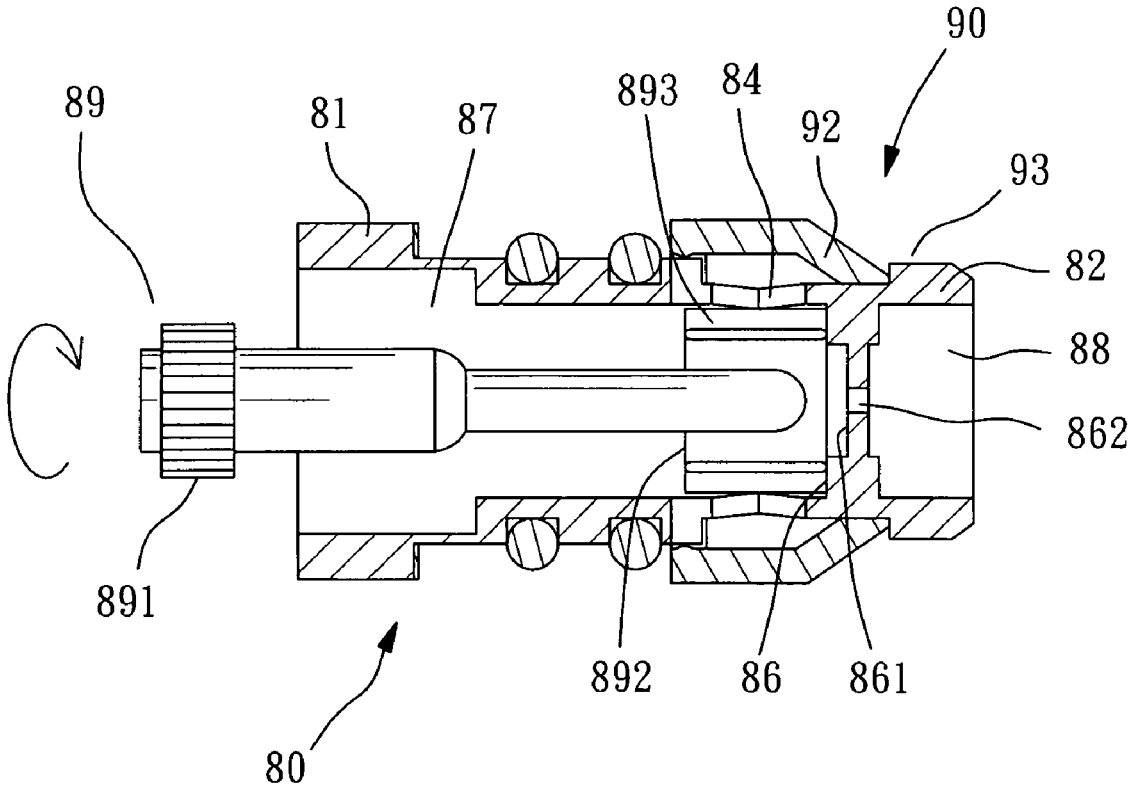
FIG. 4 is a cross sectional view of the assembly of the spray oscillating control apparatus of the present invention.
Figure 12:
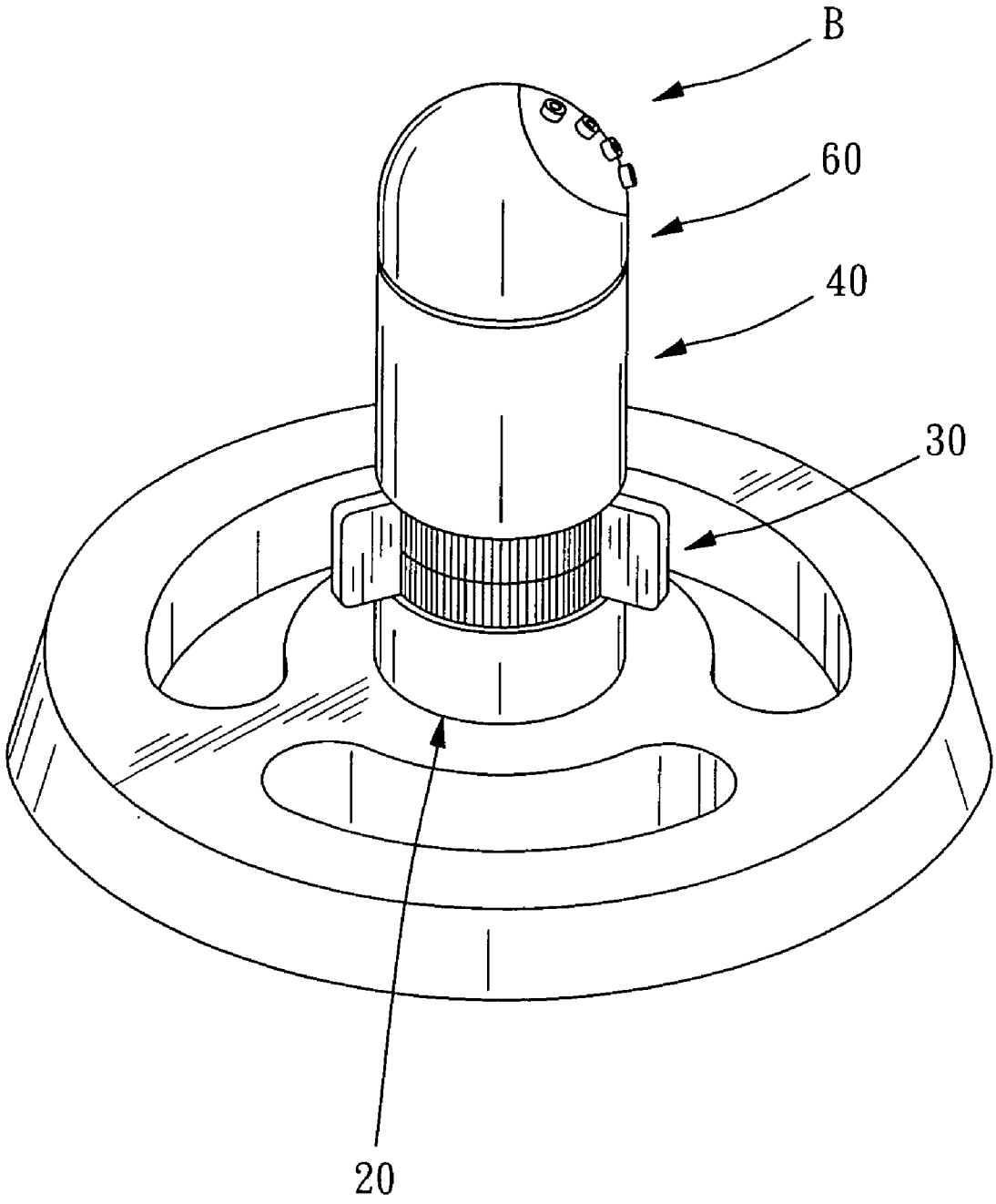
FIG. 12 is a perspective view of the present invention applied to a vertical-type sprinkler.

Please refer to FIG. 2 showing an assembled cross sectional view of the present invention. The present invention relates to a spray oscillating control apparatus for sprinklers wherein a sprinkler (made in a horizontal type or a vertical type as shown in FIG. 12) has a spray body actuated to swing into different angles via a sprinkling control assembly composed of a water inlet end 20, a positioning connector 30, a movable seat 40, a coupling seat 50, a water outlet headpiece 60, and a gear train assembly 70. The water inlet end 20 has an inlet port 21 fluidly connected to an adjusting port 221 of a water control valve 22 that can be adjusted to regulate the amount of water supply thereby. The positioning connector 30 has a restricting hole 31 disposed at one side to cooperatively work with a push rod 321 of a water intake switch device 32 so as to switch water outlets (non-illustrated in the diagram) and, thus, change the swinging direction of the spray body thereby. The coupling seat 50 is mounted between the movable seat 40 and the water outlet headpiece 60 thereof. The gear train assembly 70, having one end mounted to one side of the coupling seat 50, is accommodated to the interior of the movable seat 40 therein. The gear train assembly 70 is equipped with a front-end gear 701 to reciprocally mesh with a fixed gear 81 of a water duct 80 and a rear-end gear 702 to mesh with a drive gear linked to an impeller wherein the impeller and the drive gear are respectively situated at both sides at the center of the connector seat 50 thereof. The impeller thereof is rotated in a direction determined by that of the intake water stream flowing through the water outlets thereof. The water duct 80 is mounted to the interior of closely connected channels 23, 41 of the water inlet end 20 and the movable seat 40 thereof. The interior of the channel 23 of the water inlet end 20 is provided with a ring seat 232 having a plurality of insert blocks 231 protruding thereon for the engaging location of a positioning fitting 90 having a plurality of insert recesses 91 defining the surface thereon as shown in FIG. 3. The positioning fitting 90 has an annular tapered end equipped with a plurality of reverse-stop plates 92 and flexible plates 93 that are alternatively arranged to each other wherein each flexible plate 93 has toothed ribs 931 defining the inner surface thereon. The water duct 80 has a stepwise stop seat 82 with a toothed surface 821 defining thereon extending at the opposite end of the fixed gear 81 thereof for the coupling of the positioning fitting 90 therewith, permitting the toothed ribs 931 of the flexible plates 93 to elastically extend and mesh with the toothed surface 821 thereof respectively, and the reverse-stop plates 92 to accurately abut against the inner edge of the stop seat 82 thereon. The water duct 80 has a middle section equipped with a plurality of annular grooves 83 each having a sealing ring 831 accommodated therein, and a pair of opposite inlet orifices 84 defining thereon. The sealing rings 831 thereof are respectively abutted tight and close against the inner walls of the channels 23, 42 of the water inlet end 20 and the movable seat 40 so as to achieve watertight effect and avoid the problem of water leakage thereby. Besides, the fixed gear 81 and the stop seat 82 extending at both end edges of the water duct 80 are respectively supported by the channel 41 and the reverse-stop plates 92 thereof to retain the water duct 80 in abutting location thereby. And a lubricating plate 85 is sandwiched between the fixed gear 81 and the channel 41 thereof. The water duct 80 also has a stepwise ringed abutment seat 86 defined by a cavity 861 thereon disposed at the interior of one end therein, and a vent 862 of smaller diameter disposed at the center of the cavity 861 thereon, permitting a movement chamber 87 and a water-collecting chamber 88 to respectively form at both lateral sides of the ringed abutment seat 86 thereof. The inlet orifices 84 and the vent 862 thereof allow water stream to flow into the interior of the movable seat 40 thereby. In addition, a spray control device 89 is provided with a linkage gear wheel 891 to mesh with one matched gear 703 of the gear train assembly 70. The spray control device 89 is pivotally mounted to the interior of the movement chamber 87. At the opposite end of the linkage gear wheel 891 of the spray control device 89 is disposed a linking plate 892 and a pair of covering blocks 893 correspondingly matched to the inlet orifices 84 to form an H-shaped configuration thereby. The covering blocks 893 are symmetrically bulged outwards in the middle to figure opposite arcuate curvatures and extend at both lateral sides of the linking plate 892, permitting a water intake passageway 894 to form at both upper and lower sides of the linking plate 892 respectively. Moreover, the covering blocks 893 contact with the ringed abutment seat 86, permitting the linking plate 892 to extend across on top of the cavity 861 with an appropriate space maintained thereby as shown in FIG. 4.

Figure 5:
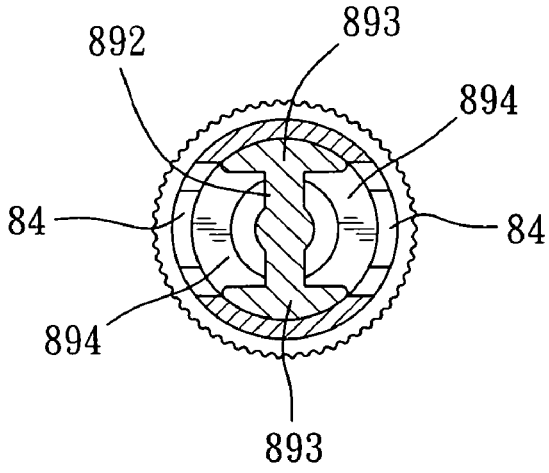
FIG. 5 is a diagram showing a spray control device of the present invention shifted to a stage of maximum water supply.
Figure 6:
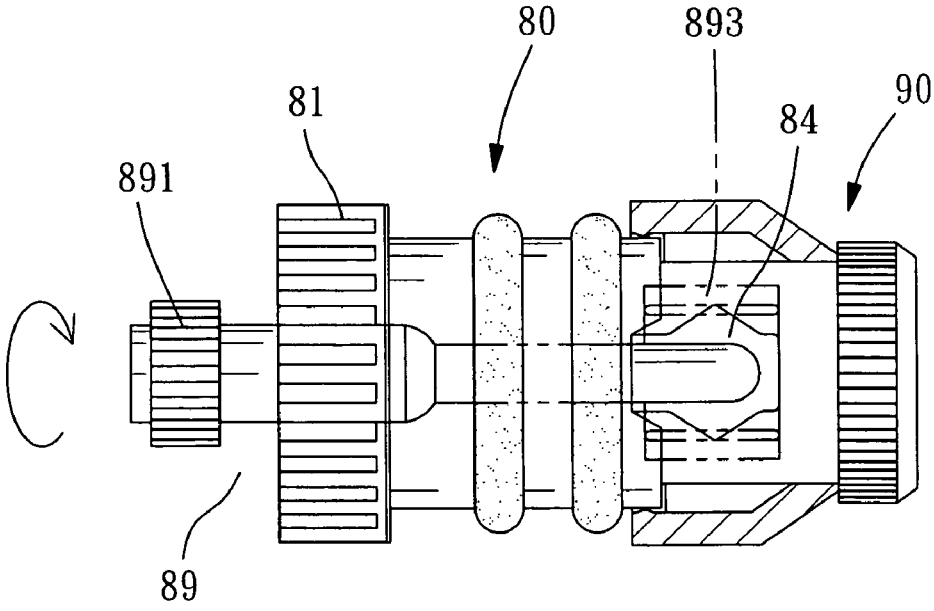
FIG. 6 is a lateral side view of FIG. 5 in rotating operation.
Figure 7:
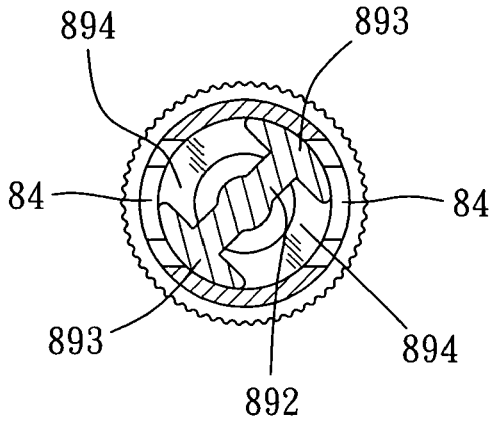
FIG. 7 is a diagram showing the spray control device of present invention gradually rotated to a stage of medium water supply.
Figure 8:
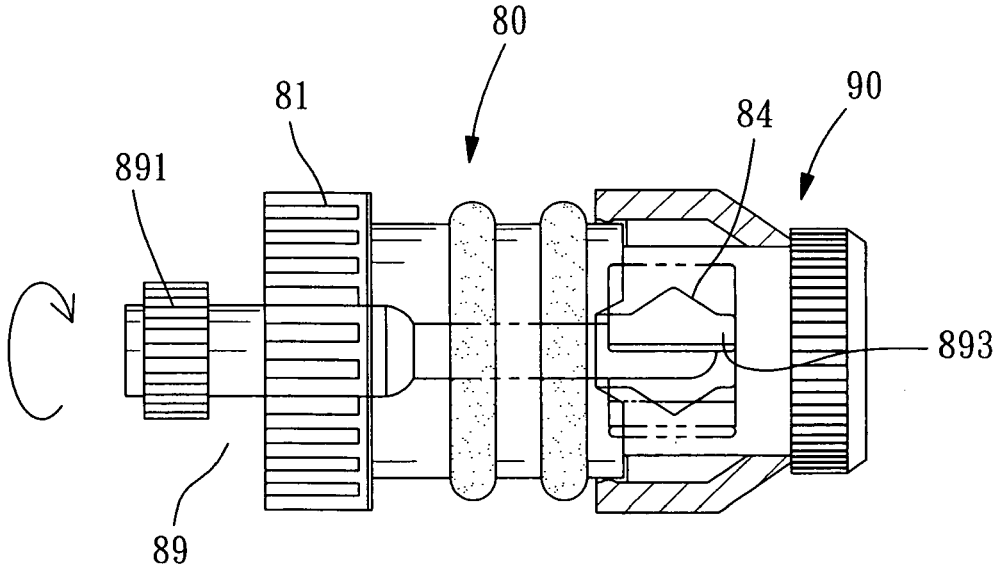
FIG. 8 is a lateral side view of FIG. 7 in rotating operation.
Figure 9:
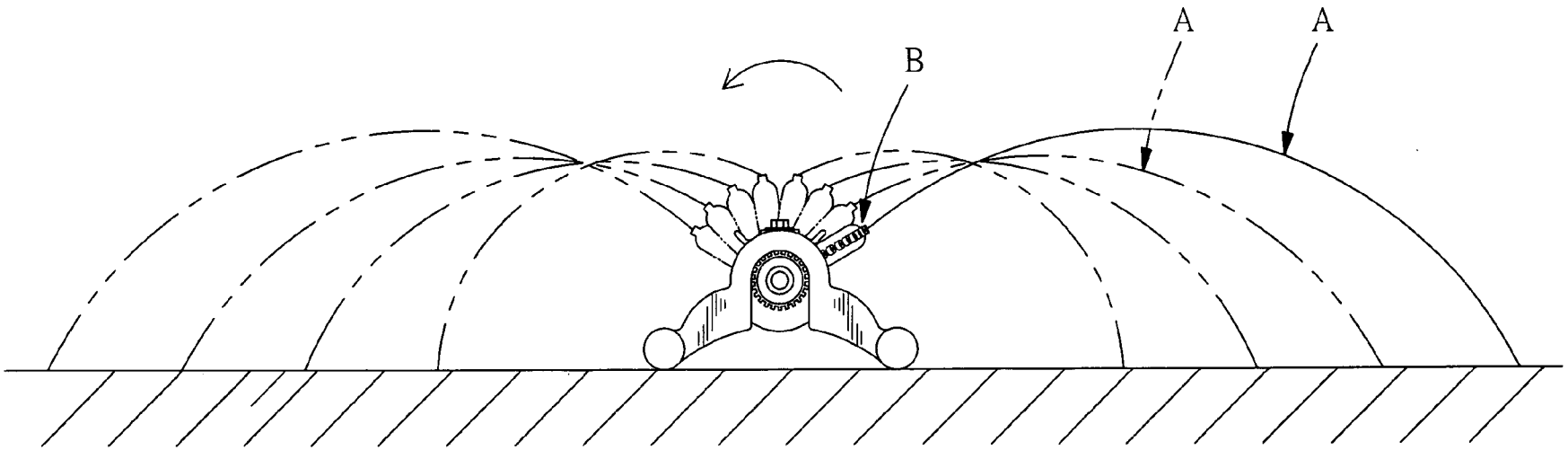
FIG. 9 is a diagram showing spray projected from the present invention and evenly distributed onto a lawn in a far-to-near and near-to-far pattern.
Figure 10:
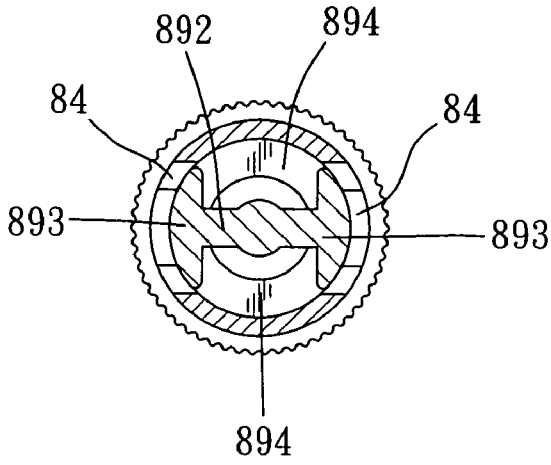
FIG. 10 is a diagram showing the spray control device of the present invention gradually rotated to a stage of minimum water supply.
Figure 11:
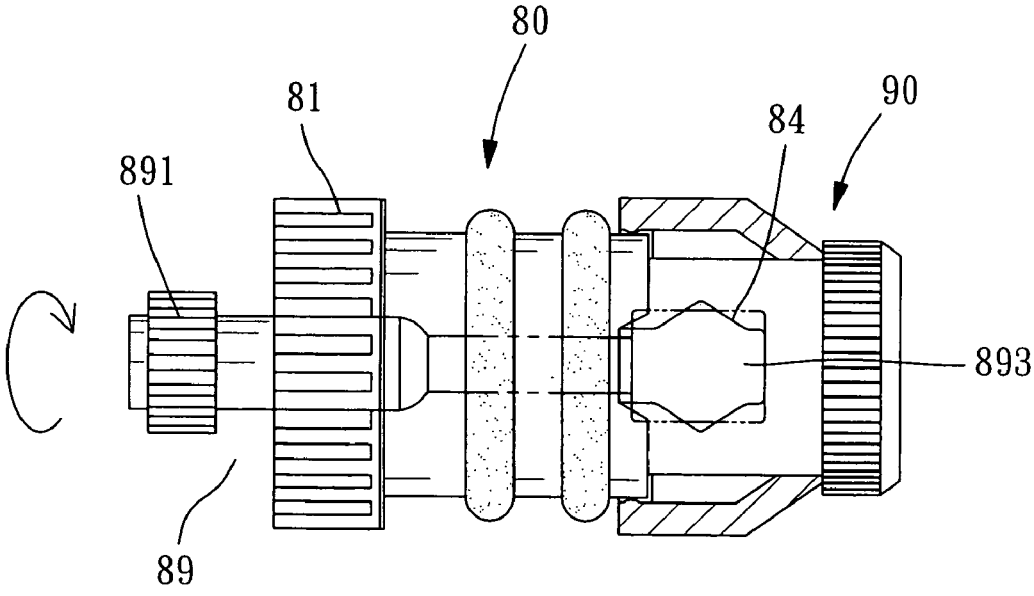
FIG. 11 is a lateral side view of FIG. 10 in rotating operation.

In operation, when the gear train assembly 70 is rotated by the drive gear of the impeller in a direction determined by that of the intake water stream to actuate the swinging movement of the spray body B therewith, the matched gear 703 of the gear train assembly 70 will rotate the linkage gear wheel 891 of the spray control device 89 in linking mechanism therewith. When the water intake passageways 894 of the spray control device 89 are completely aligned with the inlet orifices 84 thereof as shown in FIGS. 5, 6, a larger amount of water supply will be allowed to pass through the inlet orifices 84 disposed at both lateral sides of the water duct 80 and the vent 862 to stream through the movement chamber 87 and enter the movable seat 40 before flowing through the water outlets of the connector seat 50, the impeller, and the water outlet headpiece 60 in a sequence to be projected outwards via the spray body B into the atmosphere. Meanwhile, spray A can be jetted outwards to a farther distance in the stage of large water supply. And while the gear train assembly 70 persists in the rotating operation thereof, the covering blocks 893 will be gradually rotated to approach the inlet orifices 84 and cover them up step by step as shown in FIGS. 7, 8 so as to change the amount of intake water supply in a sequential order. Thus, depending on the swinging movement of the spray body B and the amount of intake water supply, the spray A projected will oscillate rhythmically from far-to-near and then near-to-far in distance to achieve an even distribution onto a lawn thereby as shown in FIG. 9. When the covering blocks 893 are rotated to completely cover up the inlet orifices 84 as shown in FIGS. 10, 11, the water stream, except infiltrating through gaps between the covering blocks 893 and the inlet orifices 84, will keep flowing through the vent 862 of the water-collecting chamber 88 to enter the movement chamber 87 thereof. Thus, even when the inlet orifices 84 are completely closed by the covering blocks 893 (that is the spray A is sprinkled to a near distance), sufficient amount of intake water supply can still be maintained to actuate the impeller and the gear train assembly 70 and facilitate normal swinging movement of the spray body B, achieving the best state of application thereby. Furthermore, the linkage gear wheel 891 of the spray control device 89 is directly meshed with one matched gear 703 of the gear train assembly 70 to form linking mechanism, permitting the covering blocks 89 to rotate therewith and switch the amount of intake water supply in a gradual manner thereby. Therefore, the spray control device 89 can avoid being interfered by the water stream in operation, and the gear train assembly 70 can accurately actuate the rotation of the spray control device 89 in a smooth and effortless manner thereby.

Furthermore, when force is exerted to bend the spray body B and synchronically move the water outlet headpiece 60, the coupling seat 50, the gear train assembly 70, and the movable seat 40 in linking mechanism, the fixed gear 81 of the water duct 80 meshed with the front-end gear 701 of the gear train assembly 70 will be actuated to rotate the water duct 80 within the channels 23, 41 of the water inlet end 20 and the movable seat 40 thereof. Meanwhile, via the design of the toothed ribs 931 of the flexible plates 93 elastically bound and meshed with the toothed surface 821 of the water duct 80, the toothed surface 821 of the water duct 80 will bounce open the flexible plates 93 of the positioning fitting 90 and run counter to the toothed ribs 931 of the flexible plates 93 to form stepwise idle rotation thereby. Therefore, when the spray body B is bent by force, resistance can be generated so as to avoid damages of the spray body B caused by excessive force exerted thereon.

Figure 13:
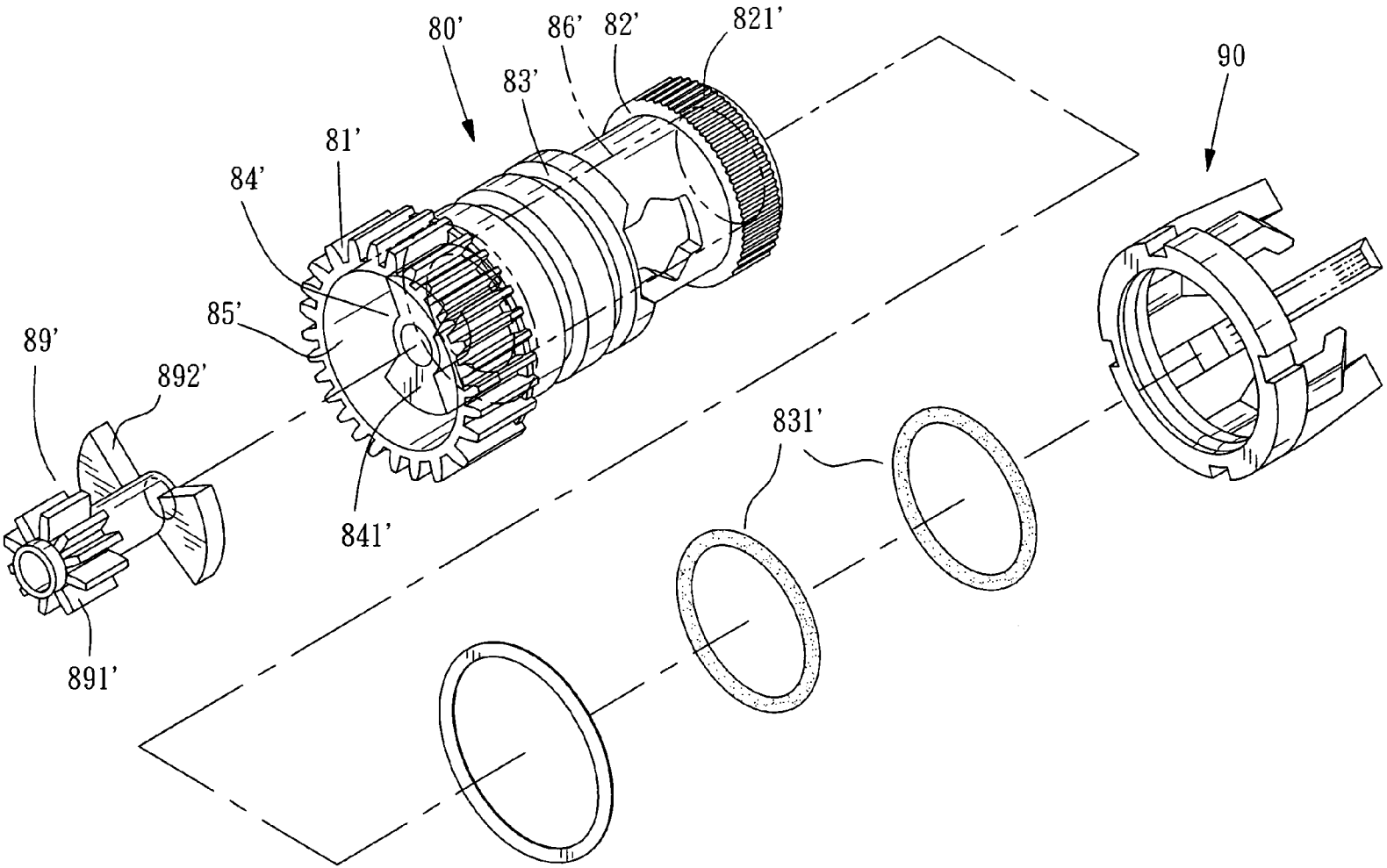
FIG. 13 is a perspective exploded view of another embodiment of the spray control device of the present invention.
Figure 14:
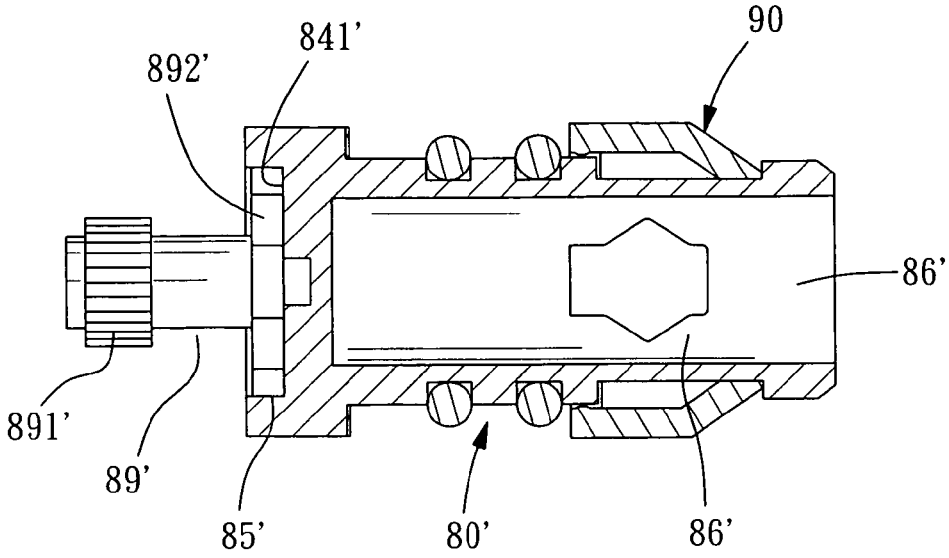
FIG. 14 is an assembled cross sectional view of another embodiment of the spray control device of the present invention.
Figure 15:
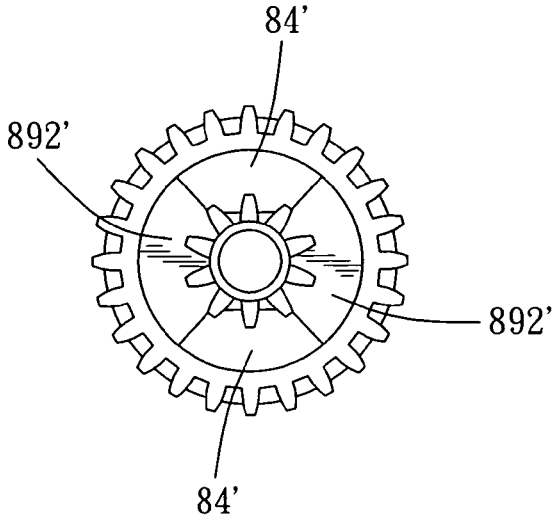
FIG. 15 is a diagram showing another embodiment of the spray control device thereof rotated to a stage of maximum water supply.
Figure 16:
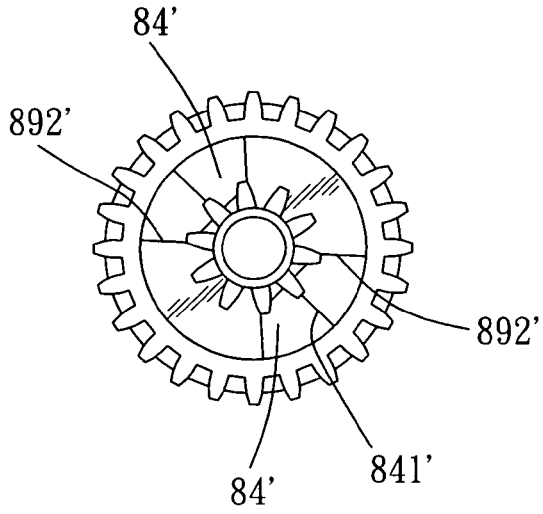
FIG. 16 is a diagram showing another embodiment of the spray control device thereof gradually rotated to a stage of medium water supply.
Figure 17:
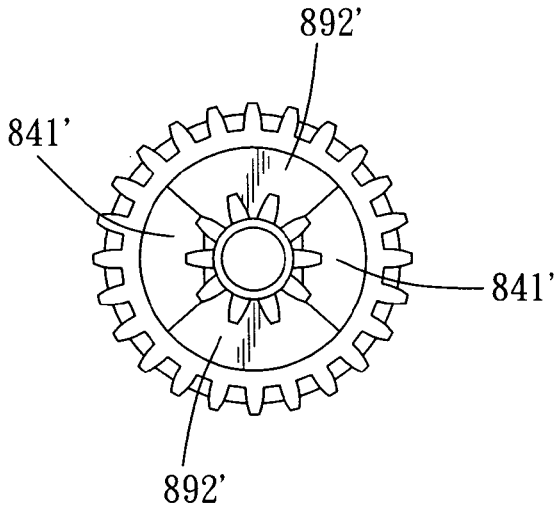
FIG. 17 is a diagram showing another embodiment of the spray control device thereof gradually rotated to a stage of minimum water supply.

Please refer to FIG. 13 showing an exploded perspective view of another embodiment of the spray oscillating control apparatus of the present invention (accompanied by FIG. 14). The present invention can also include a water duct 80' having a fixed gear 81' and a stop seat 82' defined by a toothed surface 821' extending at both ends thereof, and a plurality of annular recesses 83' preset at appropriate positions thereon for the accommodation of a sealing ring 831 therein respectively. The water duct 80' also have a pair of fan-shaped inlet orifices 84' symmetrically disposed at the inner side of one end therein to define a pair of stop faces 841' symmetrically formed there-between, permitting a movement chamber 85' and a water-collecting chamber 86' to form at both sides of the stop faces 841' and fluidly connect with the inlet orifices 84' thereof. A spray control device 89' is equipped with a linkage gear wheel 891', and a pair of covering blocks 892' extending at the opposite end of the linkage gearwheel 891' and similarly shaped like the inlet orifices 84' thereof. The covering blocks 892' thereof are made slightly larger than the inlet orifices 84'. Therefore, when the linkage gear wheel 891' of the spray control device 89' is actuated to rotate along with the gear train assembly 70 thereof, the two covering blocks 892' are allowed to rotate on the stop faces 841' thereof and gradually cover up the two inlet orifices 84' step by step so as to switch the amount of intake water supply thereby. When the covering blocks 892' completely close onto the stop faces 841', the water stream gathered at the water-collecting chamber 86' will be allowed in a larger amount to flow through the two inlet orifices 84' and the movement chamber 85' to enter the interior of the movable seat 40, permitting the spray A sprinkled to go farther in distance as shown in FIG. 15. If the covering blocks 892' keep rotating to cover up the two inlet orifices 84' in a gradual manner from a partially to completely covered stages as shown in FIGS, 16, 17, respectively, the spray A projected will oscillate from far to near in distance so as to sprinkle the lawn in an even and uniform manner.

Figure 18:
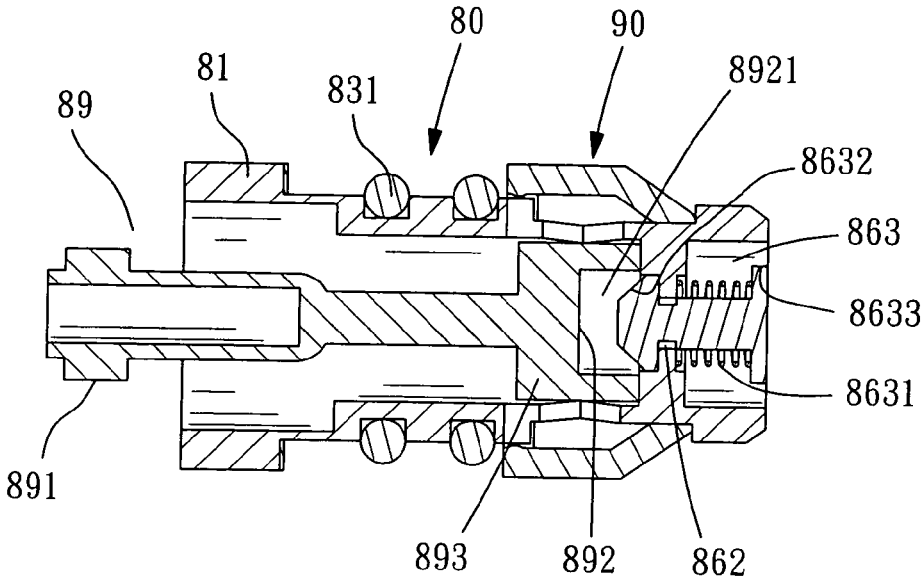
FIG. 18 is a cross sectional view of the assembly of a third embodiment of the spray oscillating control apparatus in a state of low water pressure.
Figure 19:
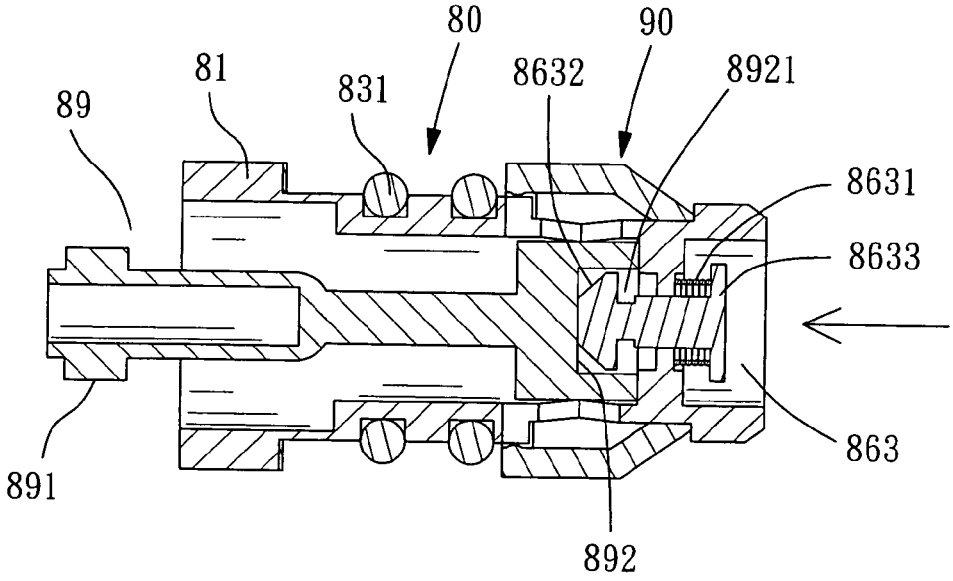
FIG. 19 is a cross sectional view of the actuation of FIG. 18 in a state of high water pressure.

Please refer to FIG. 18 showing an assembled cross sectional view of a third embodiment of the present invention applied in low water pressure. A pressure-relief valve 863 having a spring 8631 mounted thereon can be accommodated to the vent 862 of the water duct 80 thereof. Both ends of the pressure-relief valve 863 are respectively disposed a tapered stop flange 8632 and an annular stop flange 8633 wherein the annular stop flange 8633 is elastically supported by the spring 8631, permitting the tapered stop flange 8632 to precisely abut against the inner wall of the cavity 861 thereof. And the linking plate 892 of the spray control device 89 can also have a recessed groove 8921 indented at one end edge to precisely correspond to the vent 862 so that the pressure-relief valve 863 can be actuated to move within the vent 862 towards the recessed groove 8921 thereof. In case of low water pressure, the water flow will be allowed to enter through the inlet orifices 84 as well as the pressure-relief valve 863 and the vent 862 thereof. However, in case of high water pressure, the annular stop flange 8633 will be pushed by the water pressure to compress the spring 8631, and the pressure-relief valve 863 is guided to slide along the vent 862 and move towards the recessed groove 8921 as shown in FIG. 19 so as to achieve the function of pressure release thereby.

What is claimed is:

1. A spray oscillating control apparatus for sprinklers, comprising a sprinkling control assembly to actuate a swinging operation of a spray body into different angles wherein a gear train assembly with an impeller is mounted to the interior of the sprinkling control assembly, and a spray oscillating control apparatus is provided in linking mechanism with the gear train assembly; the spray oscillating control apparatus is composed of a water duct having a plurality of inlet orifices defining thereon, and a spray control device having a linkage gear wheel at one end and a plurality of covering blocks extending at the other end thereof; the linkage gear wheel of the spray control device is directly meshed with one matching gear of the gear train assembly thereof, and the covering blocks thereof are precisely matched to the inlet orifices thereof; therefore, the linkage gear wheel and the covering blocks of the spray control device are actuated by the gear train assembly to rotate therewith in a gradual manner so as to switch the amount of water supply allowed to enter the inlet orifices thereof, and, thus, spray projected can oscillate rhythmically from far-to-near and near-to-far in distance, achieving an even distribution of the spray onto a lawn thereby; wherein within a channel of a water inlet end, a ring seat is located with a plurality of insert blocks protruding thereon for engaging a location of a positioning fitting having a plurality of insert recesses that define a surface thereon and wherein the inlet orifices of the water duct can be symmetrically disposed at an outer surface communicating with the interior of the water duct, and a stepwise ringed abutment seat defined by a cavity therein is disposed within one end of the water duct; a vent of smaller diameter is disposed at the center of the cavity thereof, permitting a movement chamber and a water-collecting chamber to form a both lateral sides of the ringed abutment seat respectively; the spray control device thereof is contained within the movement chamber wherein the two covering blocks of the spray control device are disposed at both lateral edges of a linking plate to form an H-shaped configuration and symmetrically bulge outwards to figure opposite arcuate curvatures at both sides of the linking plate so as to define a water intake passageway at both upper and lower sides of the linking plate, permitting the covering blocks to abut against the ringed abutment seat and the linking plate to extend across on top of the cavity so as to maintain an appropriate space thereby.

2. The spray oscillating control apparatus for sprinklers as claimed in claim 1 wherein the sprinkling control assembly also includes a water inlet end and a movable seat that are closely joined via a set of channels for containing the water duct therein.

3. The spray oscillating control apparatus for sprinklers as claimed in claim 2 wherein a lubricating plate is coupled to an inner lateral side between the fixed gear of the water duct and the channel of the movable seat thereof.

4. The spray oscillating control apparatus for sprinklers as claimed in claim 1 wherein the positioning fitting has an annular tapered end equipped with a plurality of alternatively arranged reverse-stop plates and flexible plates each having toothed ribs defining an inner surface thereon; whereby, the annular tapered end of the positioning fitting is cooperatively coupled to a stop seat defined by a toothed surface and extending at the opposite end of the fixed gear of the water duct, permitting the toothed ribs of the flexible plates to elastically extend and mesh with the toothed surface of the stop seat, and the reverse-stop plates thereof to a precisely abut against inner side edges of the stop seat thereby.

5. The spray oscillating control apparatus for sprinklers as claimed in claim 1 wherein a middle section of the water duct is defined by a plurality of annular grooves each having a sealing ring accommodated therein.

6. The spray oscillating control apparatus for sprinkler as claimed in claim 1 where in a pressure-relief valve having a spring mounted thereon can be accommodated to the vent of the water duct thereof; both ends of the pressure-relief valve are respectively disposed a tapered stop flange and an annular stop flange wherein the annular stop flange is elastically supported by the spring, permitting the tapered stop flange to precisely abut against the inner wall of the cavity thereof; the linking plate of the spray control device can also have a recessed groove indented at one end edge thereon to precisely correspond to the vent so that according to the intensity of water pressure, the pressure-relief valve can be actuated in operation to provide the function of pressure release in case of high water pressure.

7. The spray oscillating control apparatus for sprinklers as claimed in claim 1 wherein the inlet orifices of the water duct can also be disposed at the interior of one end of the water duct and symmetrically made into a pair of fan-shaped orifices with a set of symmetrical stop faces formed there-between, permitting a movement chamber and a water-collecting chamber to form at both sides of the stop faces and fluidly connect with the inlet orifices thereof; the spray control device can also have a pair of covering blocks similarly shaped, but slightly larger than the inlet orifices, permitting the covering blocks to rotate smoothly on the stop faces to cover up the two inlet orifices in a gradual manner so as to switch the amount of intake water supply thereby.

* * * * *